US011479903B2

(12) United States Patent
Kim et al.

(10) Patent No.: US 11,479,903 B2
(45) Date of Patent: Oct. 25, 2022

(54) WASHING MACHINE

(71) Applicant: SAMSUNG ELECTRONICS CO., LTD., Suwon-si (KR)

(72) Inventors: Byeongwoo Kim, Suwon-si (KR); Baekgyu Kwon, Suwon-si (KR); Jong-Hun Sung, Suwon-si (KR); Kwangmin Chun, Suwon-si (KR); Yoonseob Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 187 days.

(21) Appl. No.: 16/881,297

(22) Filed: May 22, 2020

(65) Prior Publication Data

US 2020/0370232 A1 Nov. 26, 2020

(30) Foreign Application Priority Data

May 24, 2019 (KR) ..... 10-2019-0061090

(51) Int. Cl.
*D06F 39/12* (2006.01)
*D06F 37/26* (2006.01)
*D06F 39/14* (2006.01)

(52) U.S. Cl.
CPC ..... *D06F 39/125* (2013.01); *D06F 37/264* (2013.01); *D06F 39/14* (2013.01)

(58) Field of Classification Search
CPC ..... D06F 39/125; D06F 39/14; D06F 37/264
USPC ..... 68/140
See application file for complete search history.

(56) References Cited

U.S. PATENT DOCUMENTS

2004/0168484 A1 9/2004 Kim et al.
2014/0339970 A1 11/2014 Bae et al.

FOREIGN PATENT DOCUMENTS

| | | | |
|---|---|---|---|
| EP | 1 550 397 | A1 | 7/2005 |
| EP | 2 778 273 | A1 | 9/2014 |
| JP | 2001-276486 | | 10/2001 |
| KR | 2003-0092192 | | 12/2003 |
| KR | 10-0479093 | | 3/2005 |
| KR | 10-2010-0129171 | A | 12/2010 |
| KR | 10-1234064 | | 2/2013 |
| KR | 10-2014-0016092 | A | 2/2014 |
| KR | 10-2017-0082109 | A | 7/2017 |
| WO | WO 2015/122693 | A1 | 8/2015 |

OTHER PUBLICATIONS

KR101234064B1—machine translation (Year: 2013).*

(Continued)

*Primary Examiner* — Tinsae B Ayalew
(74) *Attorney, Agent, or Firm* — Staas & Halsey LLP

(57) ABSTRACT

Disclosed is a washing machine capable of reinforcing strength against vibration and falling by including a reinforcement member for improving strength. The washing machine includes a cabinet forming an outer appearance, a base disposed at a bottom of the cabinet, a front panel disposed at a front side of the cabinet, and reinforcement members mounted on an inner surface of the front panel to reinforce strength of the front panel, wherein each of the reinforcement members includes a protrusion portion disposed at a lower corner of the front panel and protruding such that at least a portion thereof is connected to the base.

12 Claims, 14 Drawing Sheets

(56) References Cited

OTHER PUBLICATIONS

EP2778273A1—Machine translation (Year: 2014).*
KR20030092192A—Machine translation (Year: 2003).*
International Search Report dated Sep. 11, 2020, in corresponding International Patent Application No. PCT/KR2020/006732.
Ry Christ "Samsung's smart washer/dryer lets you pick when you want the cycle to end" Jan. 10, 2019, URL: https://www.cnet.com/news/samsungs-smart-washerdryer-lets-you-pick-when-you-want-the-cycle-to-end-ces-2019/, Retrieved Mar. 27, 2019.
Extended European Search Report dated Oct. 27, 2021, in European Application No. 20 81 3734.

* cited by examiner

WASHING MACHINE

CROSS-REFERENCE TO RELATED APPLICATION(S)

This application is based on and claims priority under 35 U.S.C. § 119 to Korean Patent Application No. 10-2019-0061090, filed on May 24, 2019, in the Korean Intellectual Property Office, the disclosure of which is incorporated by reference herein in its entirety.

BACKGROUND

1. Field

The disclosure relates to a washing machine, and more particularly, to a washing machine capable of reducing vibration of a cabinet and improving strength.

2. Description of Related Art

Generally, a washing machine is a device for washing laundry by rotating a cylindrical rotary tub containing the laundry and washing water. As a type of washing machine, there are a drum washing machine in which laundry is washed by falling down after being lifted upward along an inner circumferential surface of a rotary tub as the rotary tub, which is disposed substantially horizontally, rotates in the forward and reverse directions with respect to a horizontal axis, and a vertical axis washing machine in which laundry is washed using a water current generated by a pulsator disposed inside a rotary tub as the rotary tub, which is disposed substantially vertically, rotates in the forward and reverse directions with respect to a vertical axis.

A drum washing machine includes a cabinet forming an outer appearance, a drum rotated by a rotational force of a motor inside the cabinet, a tub disposed between the drum and the cabinet to store washing water, a front panel mounted on a front side of the cabinet and formed with an opening in the center thereof such that laundry may be put into or drawn out, and a door installed on the front panel to open and close the opening and to prevent the laundry from escaping.

Recently, in order to give a drum washing machine a luxurious image, an appearance of the drum washing machine, that is, It is a trend to change the material of the cabinet from powder coating (EGI) to PCM, VCM steel plate, etc.

As this type of cabinet becomes thin, strength reinforcement due to vibration and falling may be required.

SUMMARY

It is an aspect of the disclosure to provide a washing machine capable of reinforcing strength against vibration and falling by including a reinforcement member for improving strength.

It is another aspect of the disclosure to provide a washing machine capable of preventing deformation of a corner of a front panel through a reinforcement member.

It is another aspect of the disclosure to provide a washing machine capable of preventing corner peeling of the front panel and covering a sharp edge.

Additional aspects of the disclosure will be set forth in part in the description which follows and, in part, will be obvious from the description, or may be learned by practice of the disclosure.

In accordance with an aspect of the disclosure, a washing machine includes a cabinet forming an outer appearance, a base disposed at a bottom of the cabinet, a front panel disposed at a front side of the cabinet, and reinforcement members mounted on an inner surface of the front panel to reinforce strength of the front panel, wherein each of the reinforcement members includes a protrusion portion disposed at a lower corner of the front panel and protruding such that at least a portion thereof is connected to the base.

The front panel may include a first surface formed in a plate shape to form a front surface, first side surface and second side surface extending from opposite sides of the first surface to a rear to form side surfaces of the front panel, respectively, a bottom surface extending rearward from a lower end of the first surface, a first support surface and a second support surface formed by bending in a center direction from ends of the first side surface and the second side surface, respectively, and a third support surface extending downward from an end of the bottom surface.

The front panel may include reinforcement member accommodating portions formed between an inner surface of the first surface and the first support surface and between the inner surface of the first surface and the second support surface to accommodate the reinforcement members, respectively.

The reinforcement member may include a reinforcement member body rested on the reinforcement member accommodating portion to form an outer appearance, and the protrusion portion may protrude from one surface of the reinforcement member.

The protrusion portion may include a cylindrical rib.

The base may include a lower frame configured to cover a lower side of the cabinet and a lower reinforcement frame formed by bending upward from a front end of the lower frame.

The base may include a reinforcement member hole to which the protrusion portion is coupled.

The reinforcement member hole may be formed on the lower reinforcement frame.

The reinforcement member may include a coupling portion coupled to the front panel.

The reinforcement member may include a cover portion to cover an edge of the third support surface.

The reinforcement member may include a coupling protrusion protruding from a lower side of the reinforcement member body to be coupled to the front panel, and the reinforcement member accommodating portion may include a reinforcement member coupling hole corresponding to the coupling protrusion.

The reinforcement member coupling hole may be formed on the bottom surface.

The washing machine may further include a cover member disposed between the front panel and the reinforcement member to cover the lower corner of the front panel.

The cover member may be coupled to a corner of the first surface such that at least a portion thereof is exposed.

In accordance with another aspect of the disclosure, a washing machine includes a cabinet forming an outer appearance, a front panel disposed at a front side of the cabinet, a base disposed at a bottom of the cabinet, and reinforcement members mounted on an inner surface of the front panel to reinforce strength of the front panel, wherein each of the reinforcement members comprises a protrusion portion disposed at a lower corner of the front panel be connected to the base and a cover portion configured to cover at least a portion of the front panel.

The front panel may include a first surface formed in a plate shape to form a front surface, first side surface and second side surface extending from opposite sides of the first surface to a rear to form side surfaces of the front panel, respectively, a bottom surface extending rearward from a lower end of the first surface, a first support surface and a second support surface formed by bending in a center direction from ends of the first side surface and the second side surface, respectively, and a third support surface extending downward from an end of the bottom surface.

The front panel may include reinforcement member accommodating portions formed between an inner surface of the first surface and the first support surface and between the inner surface of the first surface and the second support surface to accommodate the reinforcement members, respectively.

The base may include a lower frame configured to cover a lower side of the cabinet and a lower reinforcement frame formed by bending upward from a front end of the lower frame, and the protrusion portion may be connected to the lower frame.

The cover portion may be configured to cover an edge of the third support surface.

The washing machine may further include a cover member disposed between the front panel and the reinforcement member to cover the lower corner of the front panel, wherein at least a portion of the cover member may be exposed.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Configurations shown in the embodiments and the drawings described in the present specification are only the preferred embodiments of the present disclosure, and thus it is to be understood that various modified examples, which may replace the embodiments and the drawings described in the present specification, are possible when filing the present application.

Like reference numbers or signs in the various drawings of the application represent parts or components that perform substantially the same functions.

The terms used herein are for the purpose of describing the embodiments and are not intended to restrict and/or to limit the disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the disclosure, the first component may be referred to as a second component, and similarly, the second component may also be referred to as a first component. The term "and/or" includes any combination of a plurality of related items or any one of a plurality of related items.

Hereinafter, embodiments of the disclosure will be described in detail with reference to the accompanying drawings.

Figure 1:
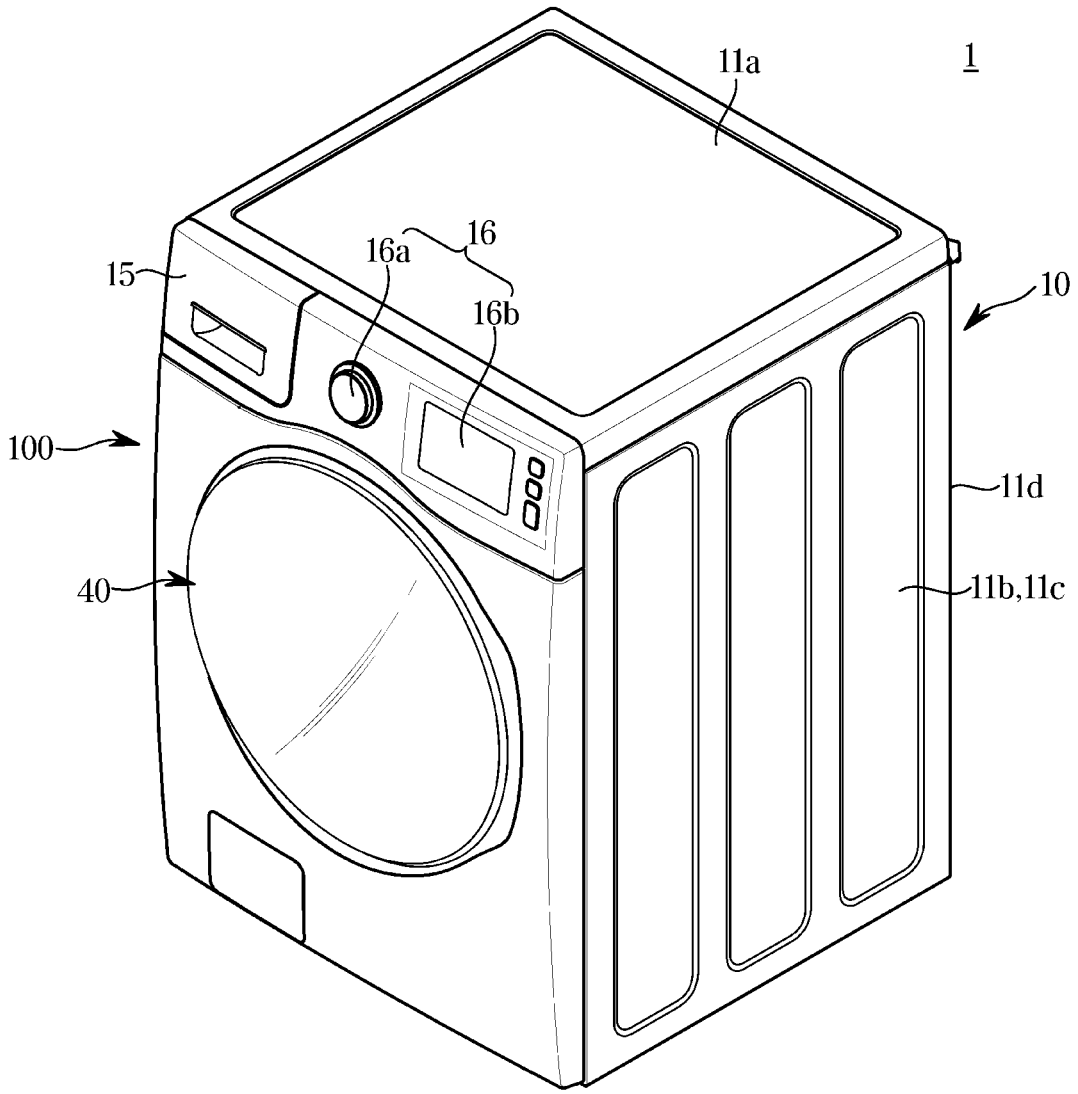
FIG. 1 is a perspective view of a washing machine according to an embodiment of the disclosure.
Figure 2:
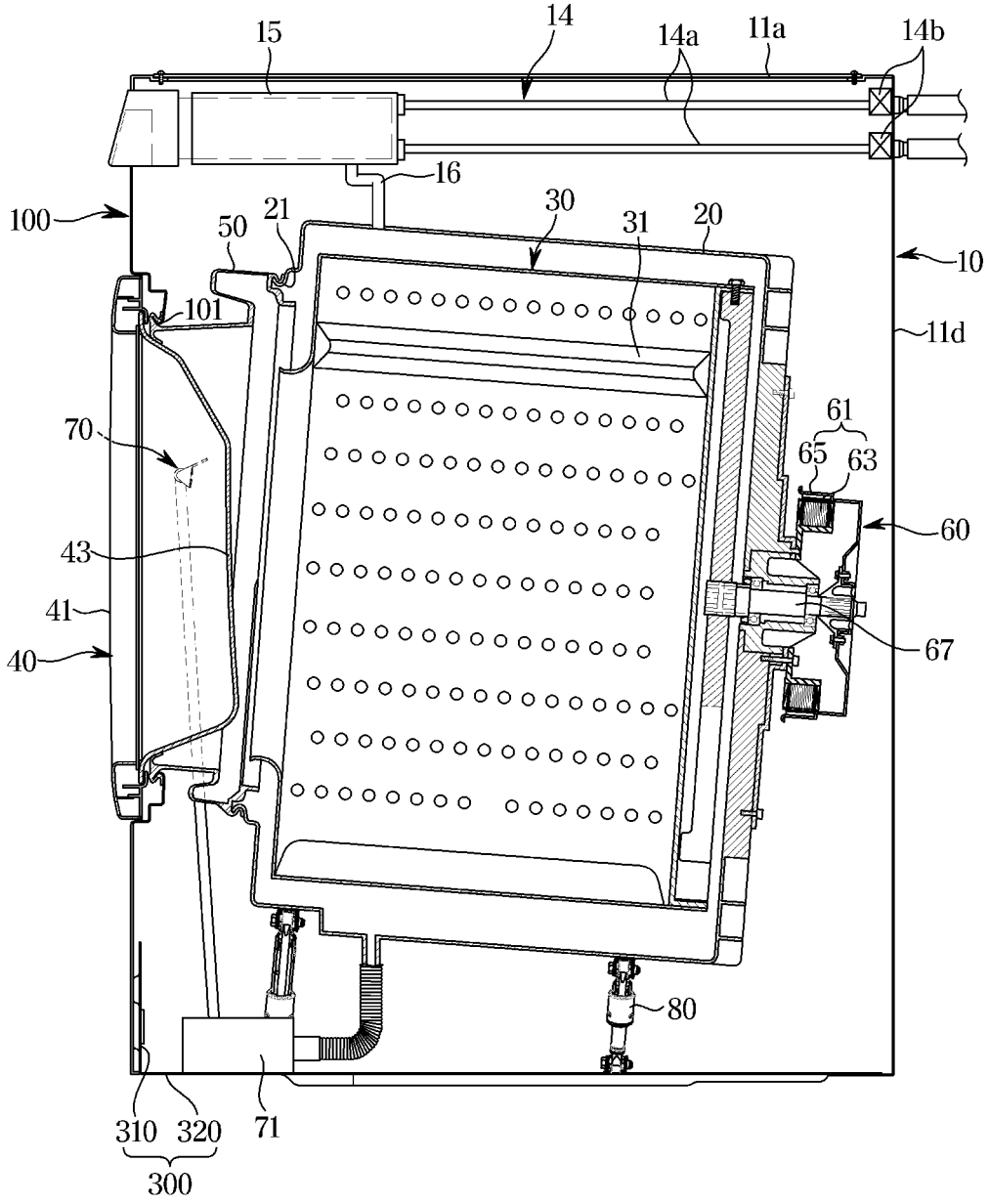
FIG. 2 is a cross-sectional view of the washing machine according to an embodiment of the disclosure.

FIG. 1 is a perspective view of a washing machine according to an embodiment of the disclosure, and FIG. 2 is a cross-sectional view of the washing machine according to an embodiment of the disclosure.

As illustrated in FIGS. 1 and 2, a washing machine 1 includes a cabinet 10 forming an outer appearance and accommodating various components therein, a tub 20 disposed inside the cabinet 10 to store mixed water in which washing water and detergent are mixed, a drum 30 rotatably disposed inside the tub 20 to receive laundry, and a driving device 60 to rotate the drum 30.

The cabinet 10 may be formed in a substantially hexahedral shape. The cabinet 10 may be formed in a box shape with an open front side. The cabinet 10 may include a rear plate 11*d* and opposite side plates 11*b* and 11*c* disposed on one side and the other side in front of the rear plate 11*d*. The embodiment of the disclosure illustrates, for example, that the rear plate and the opposite side plates of the cabinet are integrally formed, but the disclosure is not limited thereto. The cabinet 10 may include a front panel 100 disposed on the open front side, a base 300 disposed on a bottom, and a top cover 11*a* disposed on a top.

On the front side of the cabinet 10, a control panel 16 including an input 16*a* to receive an operation command from a user and a display 16*b* to display operation information of the washing machine 1 may be disposed.

The base 300 may include a lower frame 320 covering a lower portion of the cabinet 10 and a lower reinforcement frame 310 extending from the lower frame 320. The lower reinforcement frame 310 may extend upward from a front end of the lower frame 320.

An opening 101 may be formed on the front panel 100 such that laundry may be put into or drawn out the drum 30. Openings are formed on the tub 20 and the drum 30, respectively, such that laundry may be put into or drawn out through the cabinet 10, and the openings of the tub 20 and the drum 30 may be positioned to correspond to the opening 101 of the front panel 100.

The opening 101 formed on the front panel 100 may be opened and closed by the door 40. The door 40 may be rotatably mounted on the front panel 100 of the cabinet 10 by a hinge member (not shown). The door 40 may include a door frame 41 and a door glass 43. The door glass 43 may be formed of transparent tempered glass such that the inside of the cabinet 10 may be seen through.

Water supply valves 14*b* and water supply pipes 14*a* for controlling water supply; and a detergent supply device 15 for supplying detergent into the tub 20 in a water supply process may be disposed above the tub 20.

The detergent supply device 15 may be connected to the tub 20 through a supply pipe 16. Washing water supplied through the water supply pipe 14*a* is mixed with the detergent through the detergent supply device 15, and the mixed water in which the washing water and detergent are mixed may be supplied into the tub 20.

The driving device 60 may be positioned on a rear side of the drum 30. The driving device 60 configured to rotate the drum 30 may rotate the drum 30 by transmitting a driving force generated by a motor 61 to a rotation shaft 67.

The motor 61 is composed of a fixed stator 63 and a rotor 65 rotated by electromagnetic interaction with the stator 63 to convert an electrical force into a mechanical rotational force.

The tub 20 stores mixed water in which washing water and detergent are mixed, and may be formed in a substantially cylindrical shape. The tub 20 may be fixed inside the cabinet 10. The opening 101 of the front panel 100 and the tub 20 may be connected by a diaphragm 50.

A spray nozzle 70 connected to a circulation hose to spray the mixed water circulating into the drum 30 may be disposed on one side of the diaphragm 50. The spray nozzle 70 is configured to spray the mixed water evenly over the entire laundry accommodated in the drum 30. The circulation hose may be connected to a circulation pump 71 configured to pump the mixed water stored in a lower portion of the tub 20.

The drum 30 may perform washing by lifting and falling laundry while rotating inside the tub 20. A plurality of lifters 31 may be disposed on an inner surface of the drum 30.

A drain device (not shown) including a drain pipe (not shown) and a drain valve (not shown) for draining water inside the tub 20 may be disposed below the tub 20.

The tub 20 may be elastically supported in the cabinet 10 by springs (not shown) positioned above the tub 20 and dampers 80 positioned below the tub 20. That is, the springs and the dampers 80 may attenuate vibration transmitted to the cabinet 10 by absorbing vibration energy between the tub 20 and the cabinet 10 when the vibration generated by the rotation of the drum 30 is transmitted to the tub 20 and the cabinet 10.

The vibration generated when the drum 30 rotates may be transmitted to the tub 20 and the cabinet 10. A reinforcement member 200 configured to reinforce strength to reduce vibration transmitted to the cabinet 10 may be disposed on the front panel 100.

Figure 3:
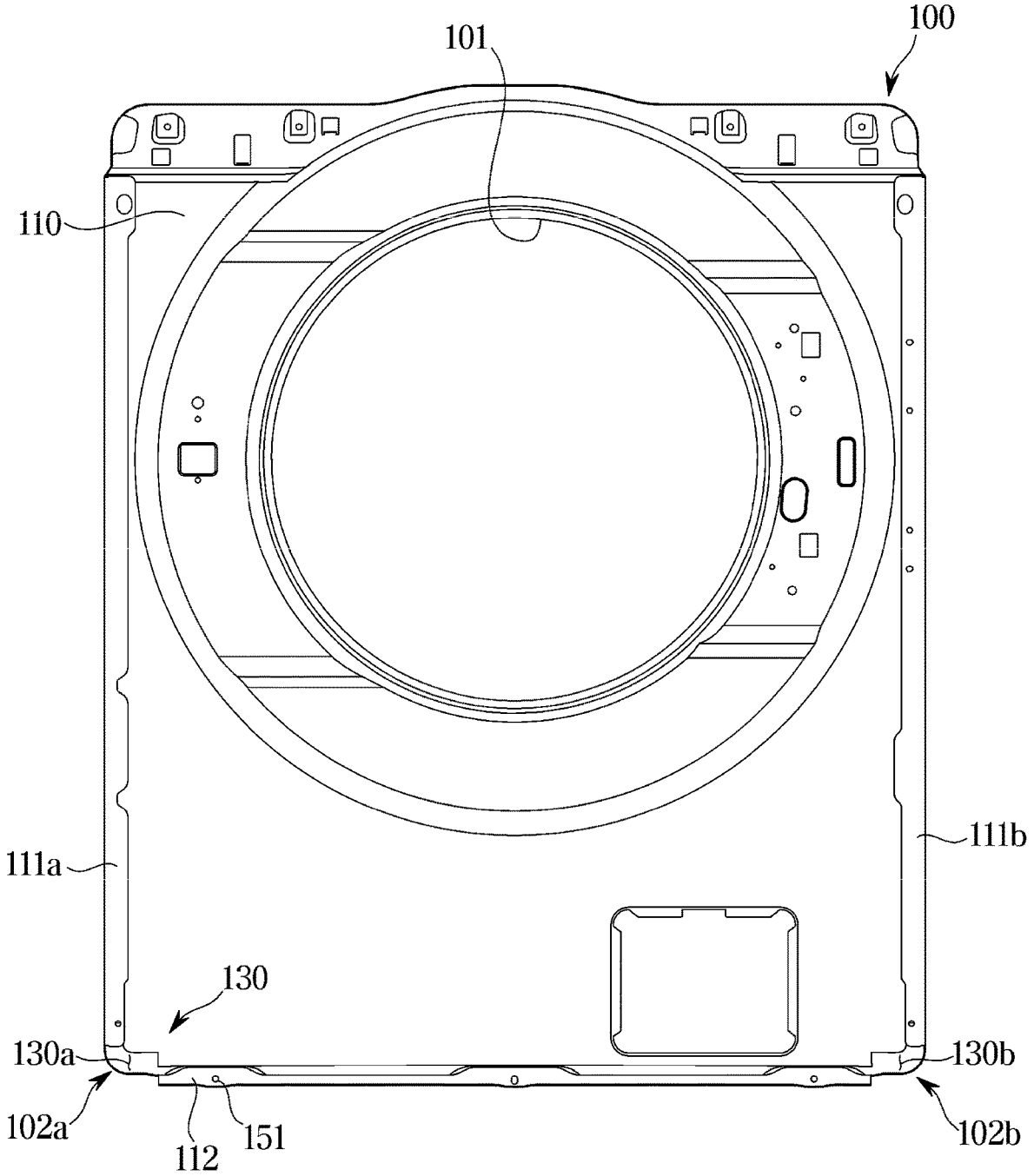
FIG. 3 illustrates a front panel of the washing machine according to an embodiment of the disclosure.
Figure 4:
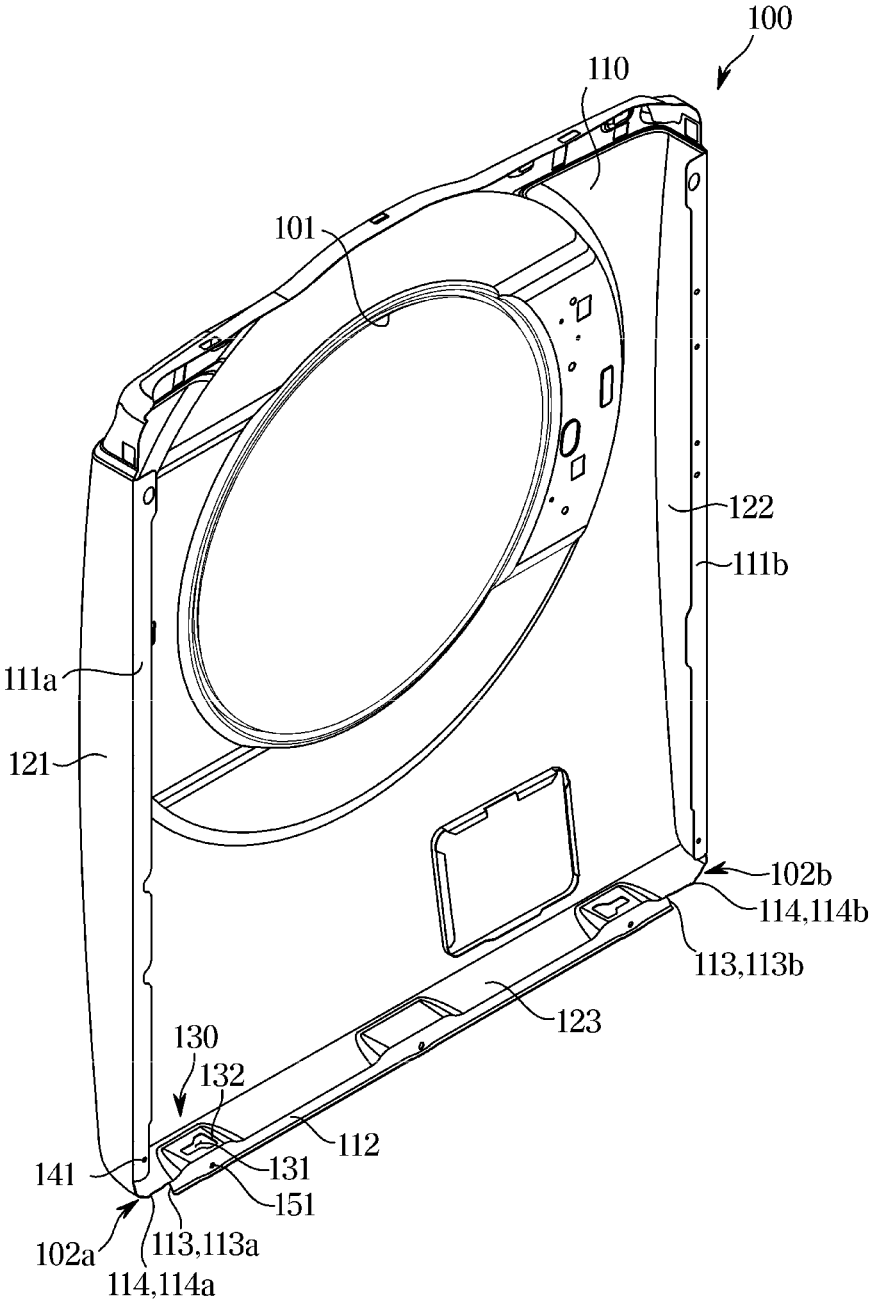
FIG. 4 is a perspective view of the front panel according to an embodiment of the disclosure.
Figure 5:
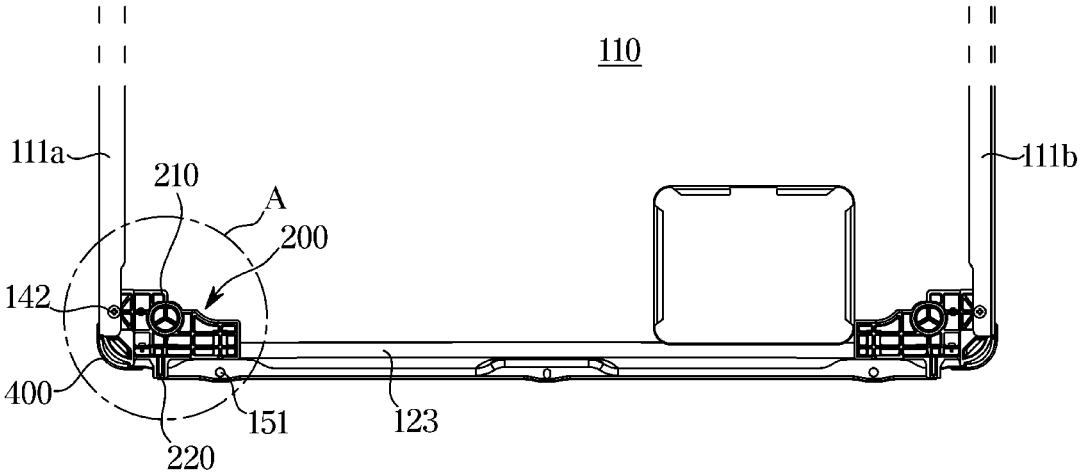
FIG. 5 illustrates a cabinet equipped with a reinforcement member according to an embodiment of the disclosure.

FIG. 3 illustrates a front panel of the washing machine according to an embodiment of the disclosure, FIG. 4 is a perspective view of the front panel according to an embodiment of the disclosure, and FIG. 5 illustrates a cabinet equipped with a reinforcement member according to an embodiment of the disclosure.

As illustrated in FIGS. 3 to 5, the front panel 100 is configured to protect the components inside the cabinet 10 and form the overall appearance of the washing machine 1. The front panel 100 may include the reinforcement member 200 for reinforcing strength to reduce vibration in the washing machine 1.

In general, the front panel 100 may be integrally manufactured by pressing and bending a single steel sheet.

The front panel 100 may include a first surface 110 forming a front surface, a first side surface 121 and a second side surface 122 extending from side surfaces of the first surface 110, respectively, to form the side surfaces of the front panel 100, and a bottom surface 123 extending from a lower end of the first surface 110 to form a bottom of the front panel 100.

The first surface 110 of the front panel 100 is formed in a plate shape, and the opening 101 may be formed in the center thereof. The first side surface 121 extending rearward from one side of the first surface 110 may include a first support surface 111*a*. The first support surface 111*a* may be formed by bending inward from an end of the first side surface 121. The first support surface 111*a* may be disposed to face the first surface 110. The first support surface 11*a* may be coupled to the side plate 11*b* of the cabinet 10. The second side surface 122 extending rearward from the other side of the first surface 110 may include a second support surface 111*b*. The second support surface 111*b* may be formed by bending inward from an end of the second side surface 122. The second support surface 111*b* may be disposed to face the first surface 110. The second support surface 111*b* may be coupled to the side plate 11*c* of the cabinet 10.

The first support surface 111*a* and the second support surface 111*b* of the front panel 100 may be formed by bending toward the inner center from the ends of the first side surface 121 and the second side surface 122, respectively. The first surface 110, the first side surface 121, and the first support surface 111*a* of the front panel 100 may be formed such that a cross section thereof has a C shape. The first surface 110, the second side surface 122, and the second support surface 111*b* of the front panel 100 may be formed such that a cross section thereof has a C shape.

The bottom surface 123 of the front panel 100 may extend rearward from the lower end of the first surface 110. The bottom surface 123 of the front panel 100 may include a third support surface 112. The third support surface 112 may be formed by bending outward from an end of the bottom surface 123. The third support surface 112 may be formed by bending downward from an end of the bottom surface 123 of the front panel 100. The third support surface 112 may be formed vertically from the bottom surface 123. The third support surface 112 may be coupled to the base 300. The third support surface 112 may include a base coupling hole 151 to be coupled to the base 300. The base coupling hole 151 may allow the front panel 100 to be coupled to the base 300. A plurality of the base coupling holes 151 may be formed on the third support surface 112. The third support surface 112 may allow the front panel 100 to be coupled to the base 300 from front to rear.

The third support surface 112 includes a cut portion 114 formed by cutting at least a portion of the bottom surface 123. The cut portion 114 includes a first cut portion 114*a* formed on one side of the third support surface 112 and a second cut portion 114*b* formed on the other side of the third support surface 112. The first cut portion 114*a* may be formed by cutting from one end of the third support surface 112 to a lower end of the first support surface 111*a*. The second cut portion 114*b* may be formed by cutting from the other end of the third supporting surface 112 to a lower end of the second supporting surface 111*b*. A first edge 113*a* may be formed on the third support surface 112 by the first cut portion 114*a*. A second edge 113*b* may be formed on the third support surface 112 by the second cut portion 114*b*. The first edge 113*a* and the second edge 113*b* may be formed at the opposite ends of the third support surface 112. A first corner 102*a* may be formed on one lower side of the front panel 100 by the first cut portion 114*a*. The first corner 102*a* may be formed at a connection portion where the first side surface 121 and the bottom surface 123 meet. The first corner 102*a* may be formed by cutting at least a portion of the first side surface 121 and the bottom surface 123 by the first cut portion 114*a*. The first corner 102*a* may be formed in a curved surface having a predetermined curvature.

A second corner 102*b* may be formed on the other lower side of the front panel 100 by the second cut portion 114*b*. The second corner 102*b* may be formed at a connection portion where the second side surface 122 and the bottom surface 123 meet. The second corner 102*b* may be formed by cutting at least a portion of the second side surface 122 and the bottom surface 123 by the second cut portion 114*b*. The second corner 102*b* may be formed in a curved surface having a predetermined curvature.

A reinforcement member accommodating portion 130 for accommodating the reinforcement member 200 may be formed at an inner lower side of the front panel 100. The reinforcement member accommodating portion 130 may include a first reinforcement member accommodating portion 130*a* disposed on one side of the front panel 100 and a second reinforcement member accommodating portion 130*b* disposed on the other side of the front panel 100.

The first reinforcement member accommodating portion 130*a* and the second reinforcement member accommodating portion 130*b* may be formed at lower left and right sides of the front panel 100; respectively. The first reinforcement member accommodating portion 130*a* and the second reinforcement member accommodating portion 130*b* may be symmetrically disposed on the left and right sides of the front panel 100.

The first reinforcement member accommodating portion 130*a* may be formed by the first surface 110 of the front panel 100, the first side surface 121, the first support surface 111*a*, and the bottom surface 123. The second reinforcement member accommodating portion 130*b* may be formed by the first surface 110 of the front panel 100, the second side surface 122, the second support surface 111*b*, and the bottom surface 123.

The first reinforcement member accommodating portion 130*a* may be formed on the first corner 102*a* of the front panel 100, and the second reinforcement member accommodating portion 130*b* may be formed on the second corner 102*b* of the front panel 100.

In the embodiment of the disclosure, because the first reinforcement member accommodating portion 130*a* and the reinforcement member 200 installed in the first reinforcement member accommodating portion 130*a* include the same structures as the second reinforcement member accommodating portion 130*b* and the reinforcement member 200 installed in the second reinforcement member accommodating portion 130*b*, redundant description is omitted.

The first reinforcement member accommodating portion 130*a* includes a reinforcement member installation surface 132 for installing the reinforcement member 200. The reinforcement member installation surface 132 may be formed on the bottom surface 123. A reinforcement member installation hole 131 may be formed on the reinforcement member installation surface 132.

By the reinforcement members 200 installed in the first reinforcement member accommodating portion 130*a* and the second reinforcement member accommodating portion 130*b*, respectively, strength of the front panel 100 may be reinforced and vibration may be reduced. In addition, the reinforcement members 200 reinforce the strength of opposite corners of the front panel 100 where high stresses are concentrated, so that the strength against falling may be reinforced when the washing machine 1 is dropped.

Figure 6:
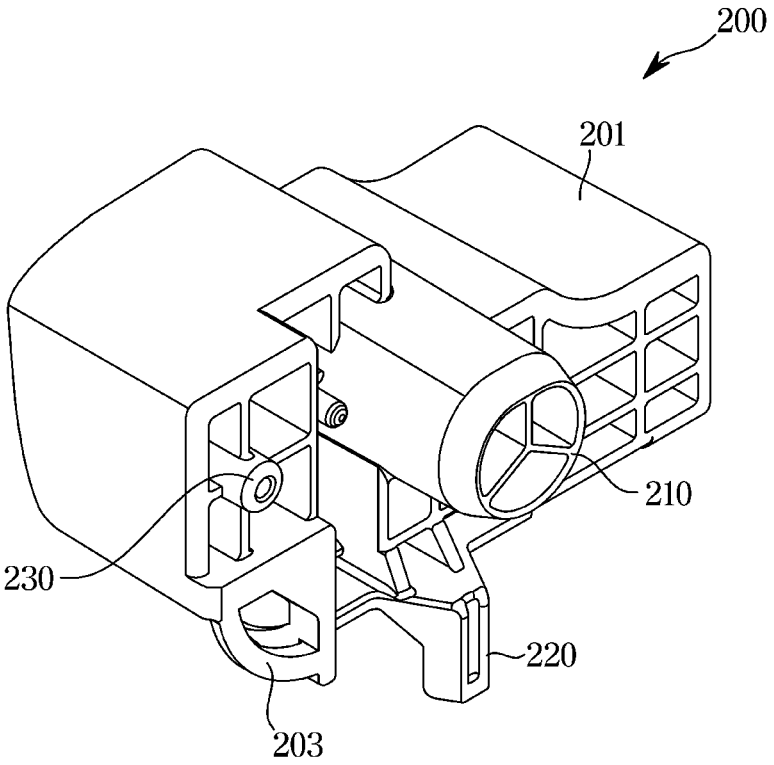
FIG. 6 is a perspective view of the reinforcement member according to an embodiment of the disclosure.
Figure 7:
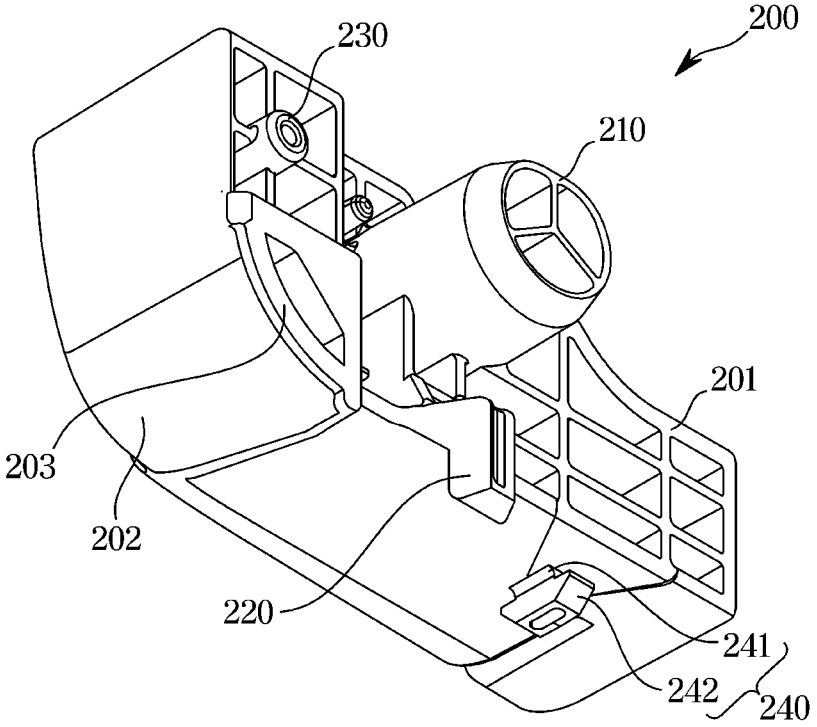
FIG. 7 is a bottom perspective view of the reinforcement member according to an embodiment of the disclosure.
Figure 8:
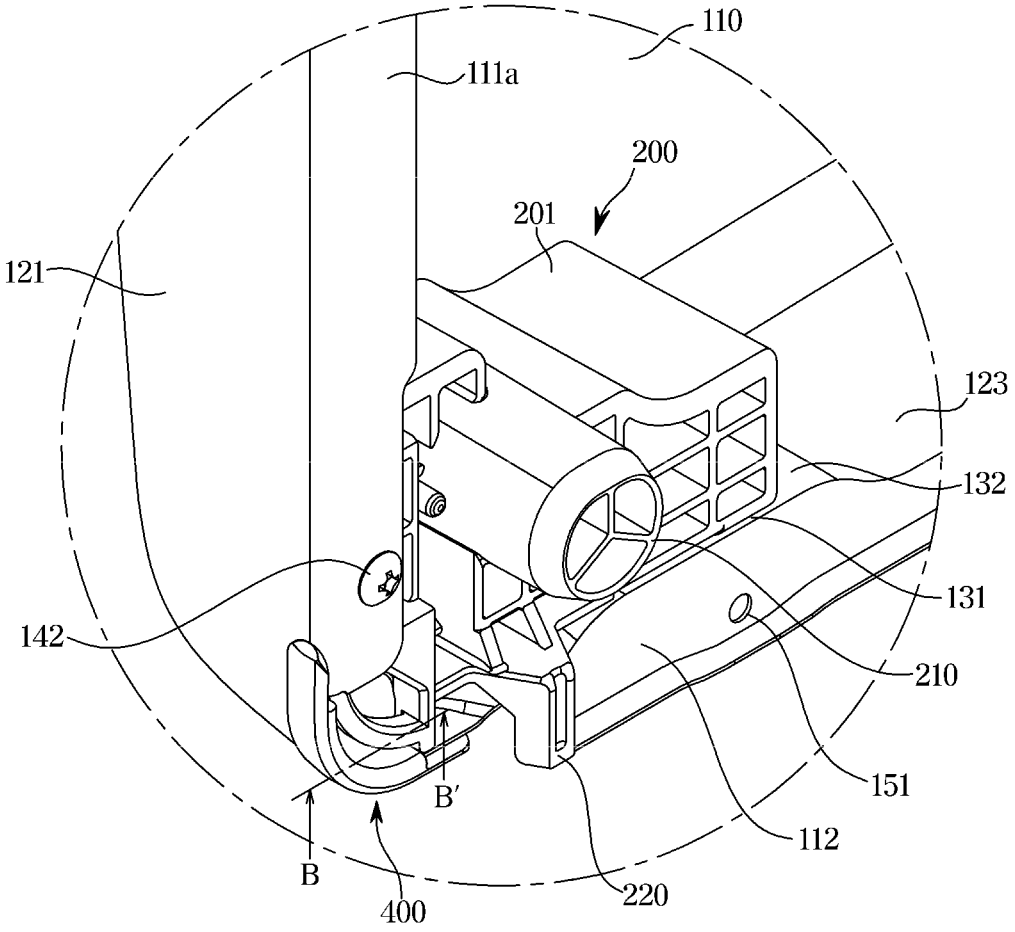
FIG. 8 is an enlarged perspective view of a portion A in FIG. 5, illustrating the cabinet equipped with the reinforcement member according to an embodiment of the disclosure.
Figure 9:
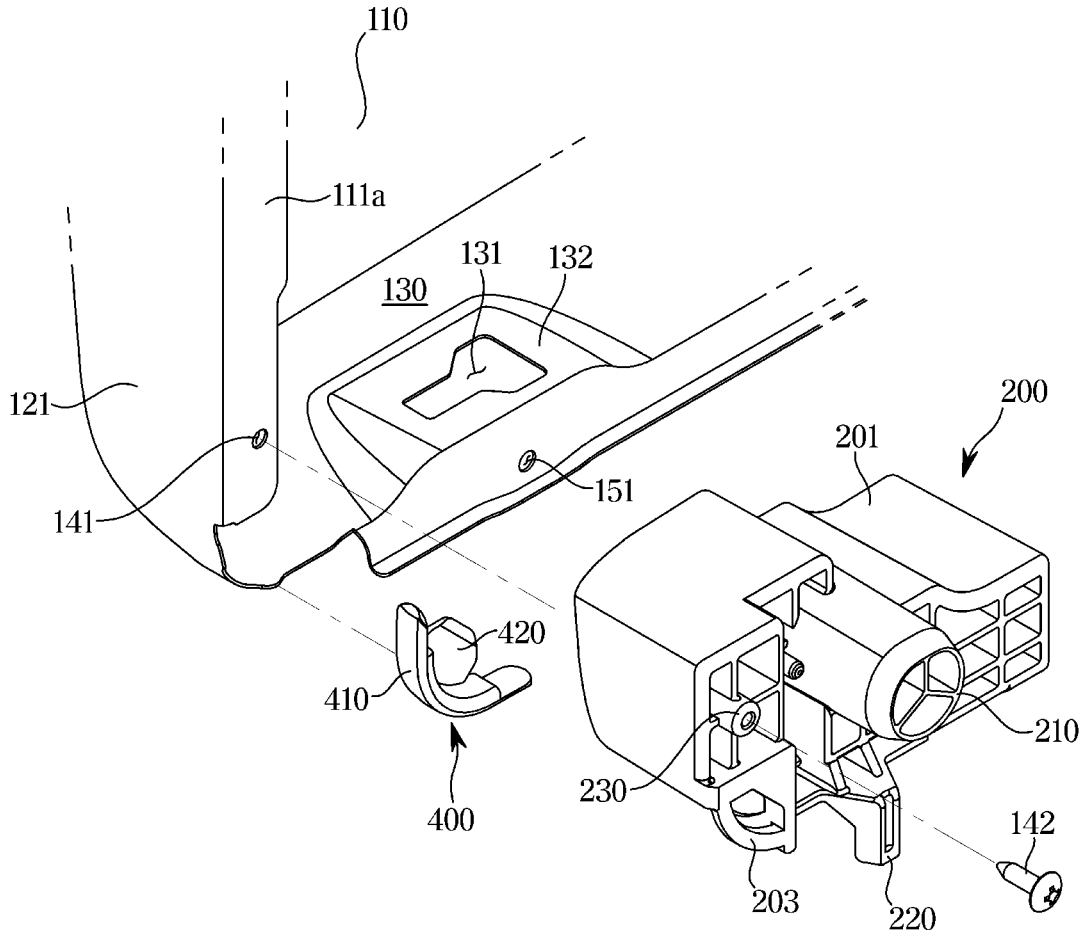
FIG. 9 illustrates the reinforcement member and a cover member mounted on the cabinet according to an embodiment of the disclosure.
Figure 10:
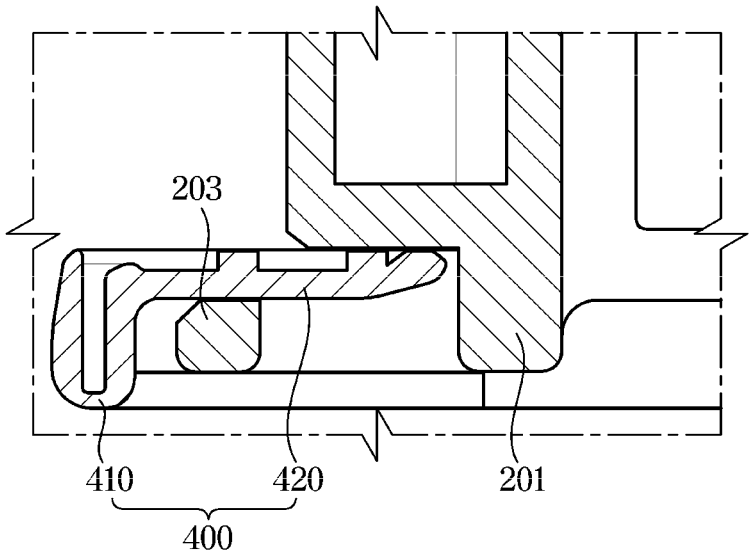
FIG. 10 is a cross-sectional view taken along line B-B' in FIG. 8, illustrating the reinforcement member mounted on the front panel according to an embodiment of the disclosure.
Figure 11:
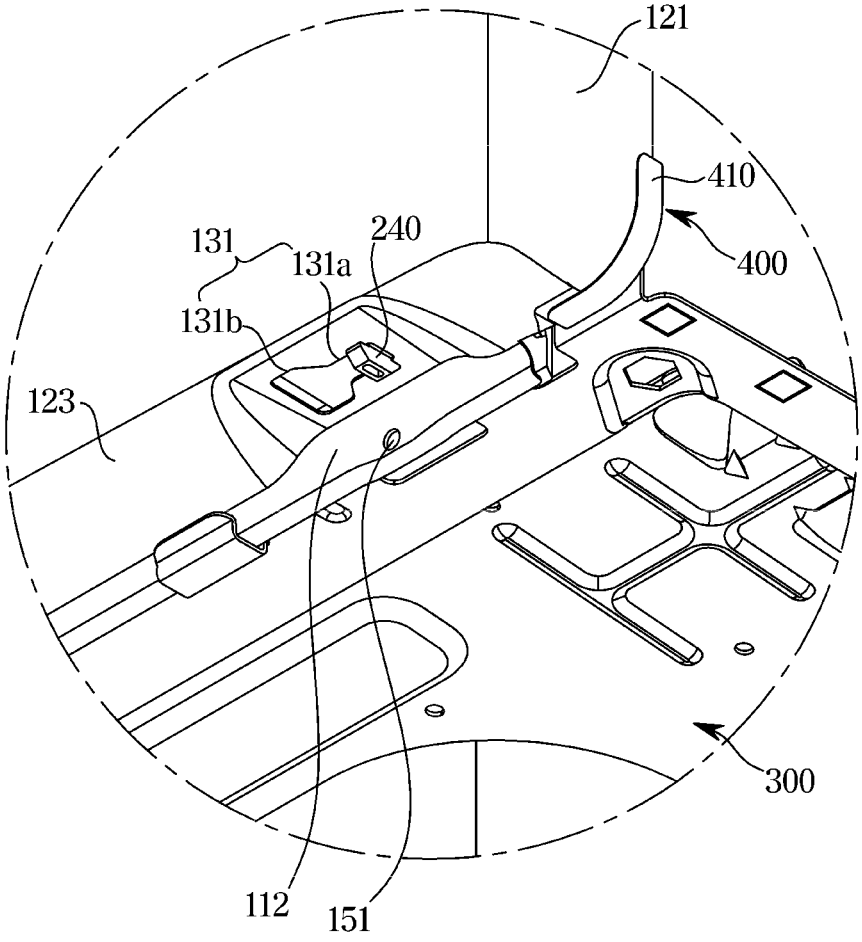
FIG. 11 is a bottom view of the cabinet equipped with the reinforcement member according to an embodiment of the disclosure.

FIG. 6 is a perspective view of the reinforcement member according to an embodiment of the disclosure, FIG. 7 is a bottom perspective view of the reinforcement member according to an embodiment of the disclosure, FIG. 8 is an enlarged perspective view of a portion A in FIG. 5, illustrating the cabinet equipped with the reinforcement member according to an embodiment of the disclosure, FIG. 9 illustrates the reinforcement member and a cover member mounted on the cabinet according to an embodiment of the disclosure, FIG. 10 is a cross-sectional view taken along line B-B' in FIG. 8, illustrating the reinforcement member mounted on the front panel according to an embodiment of the disclosure, and FIG. 11 is a bottom view of the cabinet equipped with the reinforcement member according to an embodiment of the disclosure.

As illustrated in FIGS. 6 and 11, the reinforcement member 200 includes a reinforcement member body 201 forming an outer appearance.

The reinforcement member 200 may be formed in a shape corresponding to the reinforcement member accommodating portion 130 of the front panel 100. The reinforcement member 200 may include a protrusion portion 210 protruding to be connected to the base 300. The reinforcement member 200 may include a coupling portion 230 formed to be connected to the front panel 100. The reinforcement member 200 may include a cover portion 220 to cover at least a portion of the third support surface 112 of the front panel 100.

The reinforcement member body 201 may be formed in a shape corresponding to the reinforcement member accommodating portion 130 of the front panel 100. At least a portion of the reinforcement member body 201 may include an inclined surface 202 formed as a curved surface to correspond to the first corner 102*a* of the reinforcement member accommodating portion 130.

The reinforcement member body 201 may include the protrusion portion 210 protruding to be connected to the base 300. The reinforcement member body 201 may include the coupling portion 230 formed to be connected to the front panel 100. The reinforcement member body 201 may include the cover portion 220 to cover at least a portion of the third support surface 112 of the front panel 100.

The reinforcement member body 201 includes a front surface facing the front of the washing machine 1 and a rear surface facing the rear of the washing machine 1, and the protrusion portion 210 may protrude from the rear surface of the reinforcement member body 201. The protrusion portion 210 of the reinforcement member 200 may protrude to the rear of the reinforcement member body 201. The protrusion portion 210 may be formed in a cylindrical shape. The protrusion portion 210 may include a cylindrical rib. The protrusion portion 210 may be connected to the base 300. The protrusion portion 210 may be connected to the lower reinforcement frame 310. The protrusion portion 210 of the reinforcement member 200 is connected to the base 300 to secure the fixation between the front panel 100 and the cabinet 10, thereby improving strength and reducing vibration. A reinforcement member hole 321 may be formed on the lower reinforcement frame 310 of the base 300. The reinforcement member hole 321 may be formed in a circular shape to correspond to the protrusion portion 210 of the reinforcement member 200. Although the embodiment of the disclosure illustrates that the reinforcement member hole 321 is formed in a circular shape to correspond to the protrusion portion 210 of the reinforcement member 200, the disclosure is not limited thereto. That is, the reinforcement member hole 321 may be formed in various shapes.

The protrusion portion 210 of the reinforcement member 200 is tightly fitted to the base 300 so that a gap between the front panel 100 and the cabinet 10 may be minimized when the front panel 100 is coupled to the cabinet 10. The protrusion portion 210 of the reinforcement member 200 is fitted into the reinforcement member hole 321 of the base 300 so that the front panel 100 may be tightly coupled to the base 300.

The coupling portion 230 of the reinforcement member 200 may be formed on one side of the rear surface of the reinforcement member body 201. The coupling portion 230 may be configured to fix the reinforcement member 200 to the front panel 100. A reinforcement member coupling hole 141 may be formed on the first support surface 111*a* of the front panel 100 to fix the reinforcement member 200. The coupling portion 230 of the reinforcement member 200 may be formed to correspond to the reinforcement member coupling hole 141 of the first support surface 111*a*. A fastening member 142 may penetrate the reinforcement member coupling hole 141 of the first support surface 111*a* to be fastened to the coupling portion 230 of the reinforcement member 200. The fastening member 142 may fix the reinforcement member 200 to the front panel 100 through the first support surface 111*a*.

The reinforcement member body 201 may include a coupling protrusion 240 for installation on the front panel 100. The coupling protrusion 240 may protrude from a bottom surface of the reinforcement member body 201. The coupling protrusion 240 may include a protrusion 241 and a head portion 242 extending from the protrusion 241, The head portion 242 of the coupling protrusion 240 may be formed to have a wider width than the protrusion 241. The coupling protrusion 240 may be inserted into and coupled to the reinforcement member installation hole 131 formed on the reinforcement member accommodating portion 130.

The reinforcement member installation hole 131 may be formed on the reinforcement member installation surface 132 of the bottom surface 123 of the front panel 100. The reinforcement member installation hole 131 may include a first hole 131*a* formed to allow the head portion 242 of the coupling protrusion 240 to be inserted, and a second hole 131*b* connected to the first hole 131*a*. The second hole 131*b* is formed to have a size corresponding to the protrusion 241 of the coupling protrusion 240.

Therefore, when the reinforcement member 200 is installed on the front panel 100, the head portion 242 of the coupling protrusion 240 is inserted into the first hole 131*a* and the protrusion 241 of the coupling protrusion 240 is inserted into the second holes 131*b*, so that the reinforcement member 200 may be fixed to the front panel 100. Because the head portion 242 is formed larger than the second hole 131*b*, the reinforcement member 200 may be stably coupled to the front panel 100. The reinforcement member 200 may be coupled by moving from the center of the front panel 100 in an outward direction. For example, one of the reinforcement members 200 is installed by moving from the center of the front panel 100 to the left, and the other of the reinforcement member 200 is installed by moving from the center of the front panel 100 to the right. The first hole 131*a* of the reinforcement member installation hole 131 formed on the first reinforcement member accommodating portion 130*a* may be formed outside the second hole 131*b*, and the first hole 131*a* of the reinforcement member installation hole 131 formed on the second reinforcement member accommodating portion 130*b* may be formed outside the second hole 131*b*.

The cover portion 220 of the reinforcement member 200 may be formed at a lower portion of the reinforcement member body 201. The cover portion 220 may protrude rearward from the lower portion of the reinforcement member body 201. The cover portion 220 may cover at least a portion of the front panel 100. The cover portion 220 may be disposed to correspond to the first edge 113*a* of the third support surface 112. The cover portion 220 may cover the first edge 113*a* of the third support surface 112. The cover portion 220 may be formed such that the first edge 113*a* is not exposed from the outside of the first edge 113*a* of the third support surface 112. Although the embodiment of the disclosure illustrates that the cover portion 220 is a rib protruding to a lower side of the reinforcement member body 201, the disclosure is not limited thereto. That is, the cover portion 220 may include various shapes capable of covering a sharp portion of the front panel 100.

The inclined surface 202 of the reinforcement member body 201 may include a cover member support portion 203 formed in a shape corresponding to the first corner 102*a* of the front panel 100. The cover member support portion 203 is configured to support at least a portion of a cover member 400, which will be described later. The cover member support portion 203 may be formed at one lower end of the reinforcement member body 201. The cover member support portion 203 may be formed in a fan shape.

The cover member 400 disposed between the front panel 100 and the reinforcement member 200 to cover at least a portion of the front panel 100 may be further provided. The cover member 400 may be provided on the first corner 102*a* and the second corner 102*b* of the first surface 110, respectively. The cover member 400 may be formed in a shape corresponding to the first corner 102*a* and the second corner 102*b*. The cover member 400 may cover at least portions of the first corner 102*a* and the second corner 102*b*. The cover member 400 may cover the first corner 102*a* and the second corner 102*b*. The cover member 400 may be formed such that at least a portion thereof is exposed to the outside of the front panel 100.

The cover member 400 may include a first cover body 410 and a second cover body 420 extending from the first cover body 410. The first cover body 410 may be formed to be fitted to the first corner 102*a* and the second corner of the front panel 100. The second cover body 420 may be formed in a plate shape. The first cover body 410 may be formed to protrude outward from the second cover body 420. The second cover body 420 may be disposed at an inner side of the front panel 100. The first cover body 410 may be formed such that a portion thereof is exposed to the outside of the front panel 100. The second cover body 420 may be supported by the cover member support portion 203 of the reinforcement member 200. The cover member 400 may be supported between the front panel 100 and the reinforcement member 200 by the second cover body 420 to cover the first corner 102*a* and the second corner 102*b* of the front panel 100. The cover member 400 may prevent a user from coming into contact with a sharp portion of the front panel 100 by covering the first corner 102*a* and the second corner 102*b* of the front panel 100.

Figure 12:
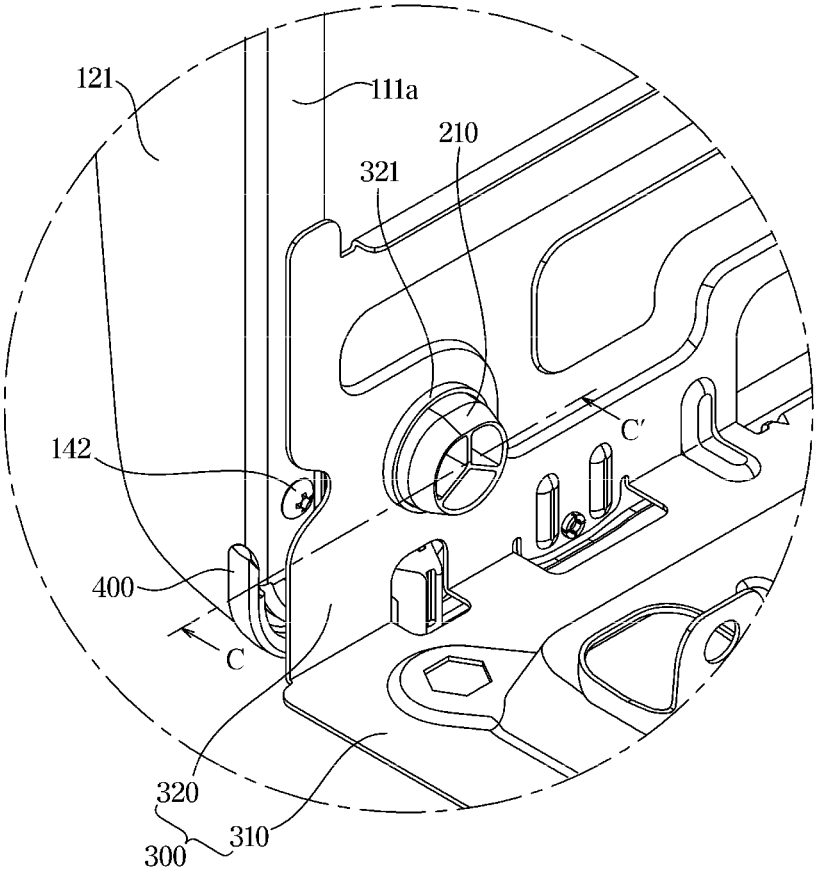
FIG. 12 illustrates coupling of the front panel and a base equipped with the reinforcement member according to an embodiment of the disclosure.
Figure 13:
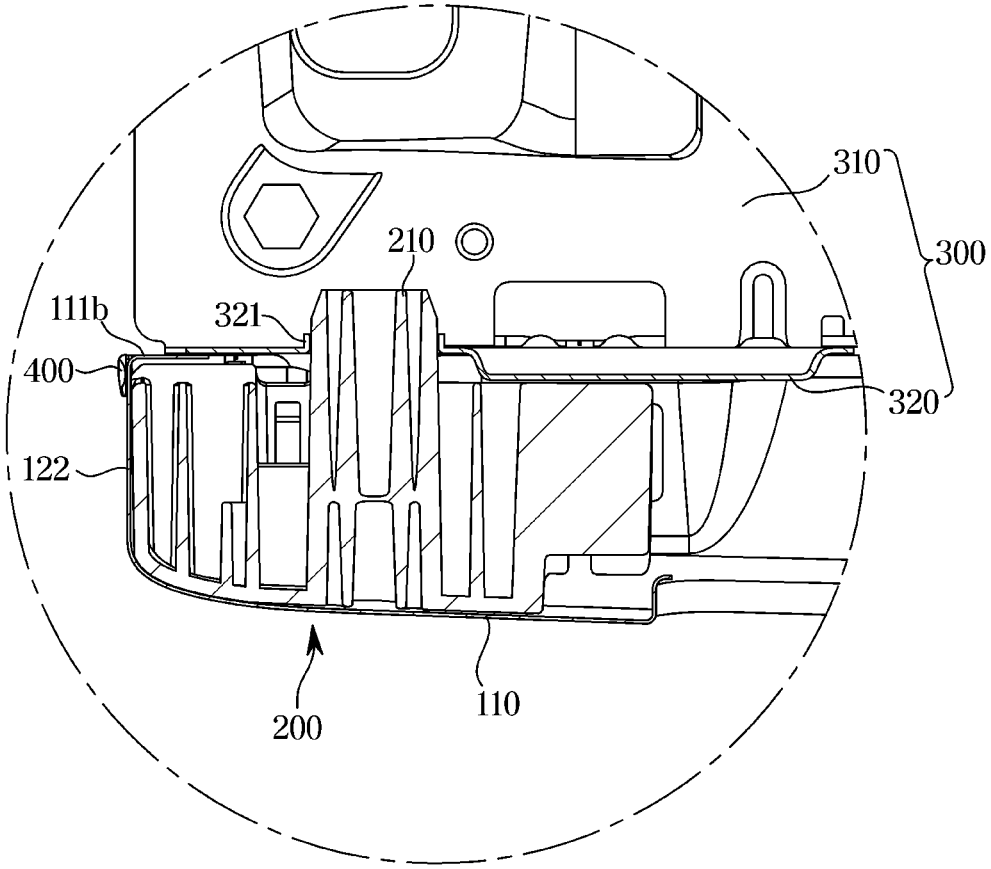
FIG. 13 is a cross-sectional view taken along line C-C' in FIG. 12, illustrating the coupling of the front panel and the base equipped with the reinforcement member according to an embodiment of the disclosure.
Figure 14:
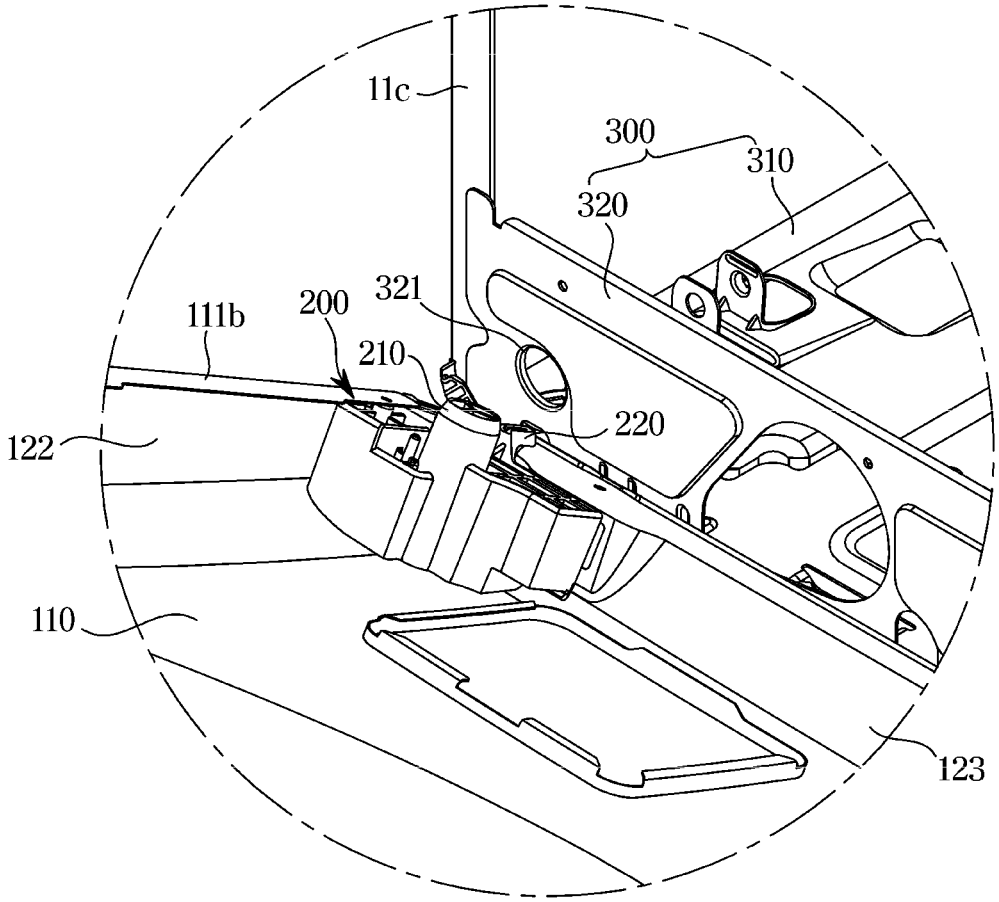
FIG. 14 illustrates the coupling of the front panel and the base equipped with the reinforcement member according to an embodiment of the disclosure.

FIG. 12 illustrates coupling of the front panel and a base equipped with the reinforcement member according to an embodiment of the disclosure, FIG. 13 is a cross-sectional view taken along line C-C' in FIG. 12, illustrating the coupling of the front panel and the base equipped with the reinforcement member according to an embodiment of the disclosure, and FIG. 14 illustrates the coupling of the front panel and the base equipped with the reinforcement member according to an embodiment of the disclosure.

As illustrated in FIGS. 12 to 14, the reinforcement member 200 may be disposed at the opposite lower corners of the front panel 100 to reduce vibration of the washing machine 1 and improve the strength of the corners of the front panel 100.

The protrusion portion 210 of the reinforcement member 200 protrudes to a rear side of the front panel 100. The base 300 coupled to the front panel 100 may be connected to the protrusion portion 210 of the reinforcement member 200. The protrusion portion 210 of the reinforcement member 200 serves as a guide when the front panel 100 is assembled to the base 300, thereby facilitating assembly work.

The protrusion portion 210 of the reinforcement member 200 may be connected to the base 300 such that the front panel 100 and the base 300 form a uniform appearance, thereby improving a sense of beauty.

The protrusion portion 210 of the reinforcement member 200 may be inserted into the reinforcement member hole 321 formed on the lower frame 320 of the base 300.

The front panel 100 may be fixed from the front to the rear of the washing machine 1 by a fixing member such as a screw 152 through the base coupling hole 151 formed on the third support surface 112 of the front panel 100. The working efficiency may be improved by the method of assembling the front panel 100 and the base 300 from the front to the rear as described above.

As is apparent from the above, according to an embodiment of the disclosure, a reinforcement member capable of improving strength is provided, so that strength against vibration and falling can be reinforced.

Further, through the reinforcement member, corner deformation and corner peeling of a front panel can be prevented, and a sharp edge can be covered.

Further, through the reinforcement member, thicknesses of the front panel and a cabinet can be reduced, thereby reducing the cost.

While the disclosure has been particularly described with reference to exemplary embodiments, it should be understood by those of skilled in the art that various changes in form and details may be made without departing from the spirit and scope of the disclosure.

What is claimed is:

1. A washing machine comprising:

a cabinet forming an outer appearance of the washing machine;

a base disposed at a bottom of the cabinet;

a front panel disposed at a front side of the cabinet and comprising a first surface formed in a plate shape to form a front surface of the washing machine, a first side surface and a second side surface extending rearward from opposite sides of the first surface to form side surfaces of the front panel, respectively, a first support surface and a second support surface bent in a center direction from ends of the first side surface and the second side surface, respectively, a bottom surface extending rearward from a lower end of the first surface, a support surface extending downward from an end of the bottom surface, and a reinforcement member accommodating portion formed between an inner surface of the first surface and the first support surface in a lower corner of the front panel; and a reinforcement member accommodated in the reinforcement member accommodating portion so as to be mounted in the lower corner of the front panel and comprising a protrusion portion that protrudes rearward from the reinforcement member past the front panel and is connected to the base, to reinforce the strength of the front panel, and a cover portion covering part of a rear edge of the support surface.

2. The washing machine according to claim 1, wherein the reinforcement member is a first reinforcement member, the lower corner is a lower left corner, and the reinforcement member accommodating portion is a first reinforcement member accommodating portion, the front panel comprises a second reinforcement member accommodating portion formed between the inner surface of the first surface and the second support surface in a lower right corner of the front panel, and the washing machine further comprises a second reinforcement member, which is a separate component from the first reinforcement member, accommodated in the second reinforcement member accommodating portion so as to be mounted in the lower right corner of the front panel and including a protrusion portion that protrudes rearward from the second reinforcement member past the front panel and is connected to the base, to reinforce the strength of the front panel, and a cover portion covering part of the rear edge of the support surface.

3. The washing machine according to claim 1, wherein the reinforcement member has a reinforcement member body rested on the reinforcement member accommodating portion, and the protrusion portion of the reinforcement member protrudes from a surface of the reinforcement member.

4. The washing machine according to claim 3, wherein the protrusion portion of the reinforcement member comprises a cylindrical rib.

5. The washing machine according to claim 4, wherein the base comprises a lower frame covering a lower side of the cabinet and a lower reinforcement frame bent upward from a front end of the lower frame.

6. The washing machine according to claim 4, wherein the base comprises a reinforcement member hole to which the protrusion portion of the reinforcement member is coupled.

7. The washing machine according to claim 6, wherein the base comprises a lower frame covering a lower side of the cabinet and a lower reinforcement frame bent upward from a front end of the lower frame, and the reinforcement member hole is formed on the lower reinforcement frame.

8. The washing machine according to claim 4, wherein the reinforcement member comprises a coupling portion coupled to the front panel.

9. The washing machine according to claim 3, wherein the reinforcement member comprises a coupling protrusion protruding from a lower side of the reinforcement member body and coupled to the front panel, and the reinforcement member accommodating portion comprises a reinforcement member coupling hole corresponding to the coupling protrusion.

10. The washing machine according to claim 9, wherein the reinforcement member coupling hole is formed on the bottom surface.

11. The washing machine according to claim 1, further comprising:

a cover member disposed between the front panel and the reinforcement member to cover the lower corner of the front panel.

12. The washing machine according to claim 11, wherein the cover member is coupled to a corner of the first surface such that at least a portion of the cover member is exposed to outside of the washing machine.

* * * * *